US005383307A

United States Patent [19]

Anderson

[11] Patent Number: 5,383,307

[45] Date of Patent: Jan. 24, 1995

[54] SKATE BLADE EDGE RESURFACER

[75] Inventor: Bradley J. Anderson, Alexandria, Minn.

[73] Assignee: Edge Specialties, Inc., Alexandria, Minn.

[21] Appl. No.: 176,464

[22] Filed: Jan. 3, 1994

Related U.S. Application Data

[63] Continuation-in-part of Ser. No. 44,749, Apr. 14, 1993.

[51] Int. Cl.[6] ..... B24D 5/00

[52] U.S. Cl. ..... 451/545; 451/548; 451/555; 451/558

[58] Field of Search ..... 51/358, 364, 370, 382, 51/383, 384, 205 WG, 205 R, 211 R, 204, 211 H, 214, 285, 206 R, 208, 391

[56] References Cited

U.S. PATENT DOCUMENTS

| | | | |
|---|---|---|---|
| D. 295,142 | 4/1988 | Patrick | D8/91 |
| 1,273,624 | 7/1918 | Krollius . | |
| 2,054,495 | 9/1936 | Corkum . | |
| 2,092,831 | 9/1937 | Cannon | 51/205 WG |
| 2,118,617 | 5/1938 | Nicolet | 51/205 WG |
| 2,398,566 | 4/1946 | Talbert | 51/205 |
| 2,428,473 | 10/1947 | Slocum . | |
| 2,550,765 | 5/1951 | Brown | 51/187 |
| 3,596,411 | 8/1971 | Hutchins | 51/364 |
| 3,841,030 | 10/1974 | Laszlo | 51/170 PT |
| 5,197,232 | 3/1993 | Ellestad | 51/205 WG |

*Primary Examiner*—Bruce M. Kisliuk
*Assistant Examiner*—Eileen Morgan
*Attorney, Agent, or Firm*—Burd Bartz & Gutenkauf

[57] ABSTRACT

A hand held skate blade sharpening tool has a rotatable cylindrical member having an outer sleeve made of a sharpening stone material retained within a channel-shaped body member. Removable screws threaded through the body engage bearings rotatably mounted on the outer ends of the cylindrical member to limit longitudinal movement of the stone within a channel of the body member. The body member has an access slot extending radially from the stone. Elongated guides projecting upwardly adjacent the slot are transversely spaced at a distance substantially the same as the width of the skate blade to guide and limit lateral movement of the blade within the slot. Grooves in the bearings are aligned with the slot whereby the bearings do not interfere with movement of the tool along the skate blade. A transverse groove interrupting the slot and guides is open to the channel exposing the stone sleeve. This enables the cylindrical member to be manually rotated within the channel to rotate an unused sharpening surface of the sleeve into alignment with the slot.

28 Claims, 7 Drawing Sheets

SKATE BLADE EDGE RESURFACER

This application is a continuation-in-part of U.S. application Ser. No. 08/044,749, filed Apr. 14, 1993 still pending.

FIELD OF THE INVENTION

The invention relates to tools for sharpening ice skate blades, particular skate blades having two edges located between a hollow concave curved surface.

BACKGROUND OF THE INVENTION

Commonly, ice skates are sharpened or touched-up using a rotating grinding wheel of a grinding machine. The grinding machine takes a sizeable cut out of the blade each time it is used to sharpen the blade which reduces the useful life of the blade. The blades become excessively sharp increasing the risk of injury. Also, the cost of using the grinding machine limits the number of times a skater can affordably sharpen his or her skates.

An alternative to the grinding machine is to use hand held sharpening tools. These tools have a stone that is moved back and forth lengthwise along the skate blade. The stone sharpening surface quickly wears or becomes dirty whereby the tool has to be replaced.

SUMMARY OF THE INVENTION

The invention is directed to a hand operated ice skate sharpening tool that functions to prolong skate blade life and lower costs associated with conventional grinding methods of skate sharpening. The sharpener has a cylindrical sharpening stone rotatable within a housing whereby unused surfaces of the stone can be rotated and used to sharpen ice skate blades. The stone is easily removed from the housing for replacement or cleaning of the stone.

The sharpener has a generally rectangular body with opposite ends. A cylindrical bore extends longitudinally through the body. The bore is open to each end of the body. A cylindrical stone is located in the bore for sharpening edges of a skate blade. The diameter of the stone is slightly less than the diameter of the bore so that the stone can be rotated within the bore to position unused surfaces of the stone adjacent the edges of the skate blade. The stone has a convex curved outer surface that is complementary to the concave curve on the bottom surface of the blade. The stone can be removed from the bore through one of the open ends of the body for replacement or cleaning purposes. Pins located in holes in the body adjacent the ends of the stone extend into the bore to fix the longitudinal position of the stone within the bore. Each pin has open side ends so that the diameter of the pin can be reduced to remove the pin from the hole and thereby facilitate removal of the stone from the bore.

The body of the sharpener has an elongated slot that extends generally parallel to the longitudinal axis of the bore. The slot is open to the top of the bore and also to the opposite ends of the body. This provides access to the outer surface of the stone for the blade to be sharpened. After being prepped with honing oil the blade is inserted into the slot to position the bottom surface of the blade in engagement with the outer surface of the stone. Upwardly projecting flanges joined to the body adjacent the slot have transversely spaced inner surfaces aligned with the outer sides of the slot. The sharpener is then moved lengthwise along the blade in both longitudinal directions to sharpen the edges of the blade. The slot has a width substantially the same as the width of the blade to prevent lateral movement of the blade within the slot. Flanges guide the blade as the sharpener is moved relative to the blade. The sharpening procedure results in blade edges having a non-excessive sharpness facilitating skating and reducing risk of injury. A transverse groove in the sharpener body has a bottom portion that intersects the top portion of the bore. This exposes the top surface of the stone to facilitate the rotation thereof within the bore. The user uses a thumb or finger to slightly rotate the stone and position an unused surface of the stone in alignment with the slot. When all of the outer surface of the stone becomes worn the stone can be replaced by removing the pin from the housing and removing the stone from the bore.

A modification of the sharpener has a generally rectangular body with opposite ends and a cylindrical bore that extends longitudinally through the body opening to each end of the body. A generally cylindrical member is located in the bore. The member has opposite ends that are rotatably mounted on annular bearings that fit into the ends of the bore. A tubular sleeve of stone material is attached to the outer surface of the cylindrical member and is used to sharpen edges of a skate blade. The cylindrical member rotates on bearings to position an unused surface of the sleeve adjacent the edges of the blade. The bearings function to prolong the useful life of the cylindrical member. The sleeve has a convex curved outer surface complementary to the curve of the bottom surface of the blade. Screws threaded through vertical holes in the body engage the bearings to fix the longitudinal position of the cylindrical member within the bore. The screws are turned out of engagement with the bearings so that the cylindrical member can be removed from the bore through one of the open ends of the body for replacement or cleaning purposes.

The body of the sharpener has an elongated slot extending generally parallel to the longitudinal axis of the bore. The slot is open to the top of the bore and to the ends of the body. This provides access to the outer surface of the sleeve so that the blade can be sharpened. Upwardly projecting flanges joined to the body have transversely spaced inner surfaces that are aligned with the inner surfaces of the body forming the slot and are used to guide the blade as the sharpener is rubbed against the blade. The distance between the flanges and the width of the slot are substantially the same as the width of the blade to prevent lateral movement of the blade within the slot. Grooves in the bearings are aligned with the slot to allow the sharpener to be moved lengthwise along a skate blade without interference from the bearings. A transverse groove in the sharpener body has a bottom portion intersecting a top portion of the bore whereby the cylindrical member can be rotated by the user person as desired.

DESCRIPTION OF THE PREFERRED EMBODIMENT

Figure 1:
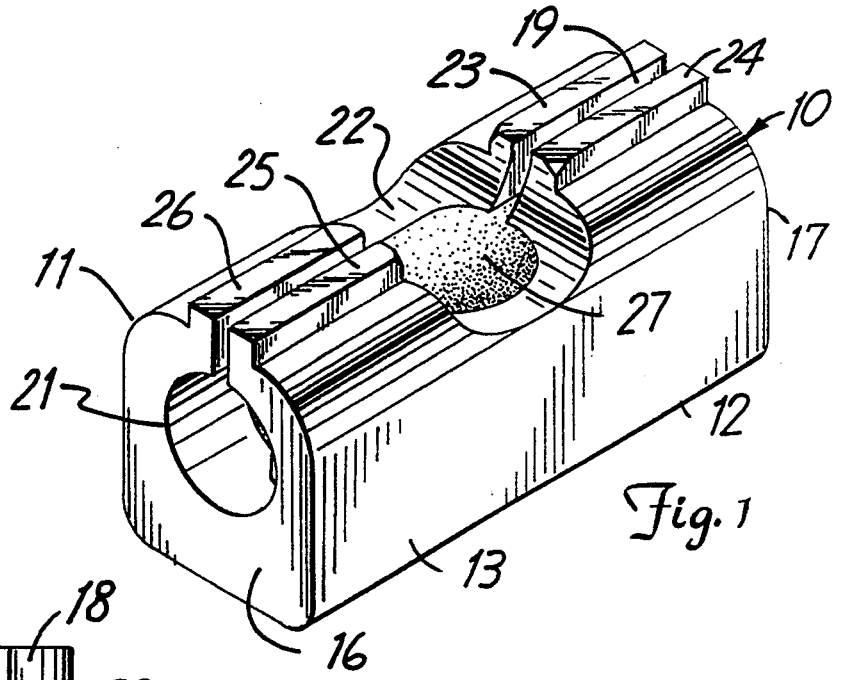
FIG. 1 is a perspective view of an ice hockey skate sharpener of the invention.
Figure 2:
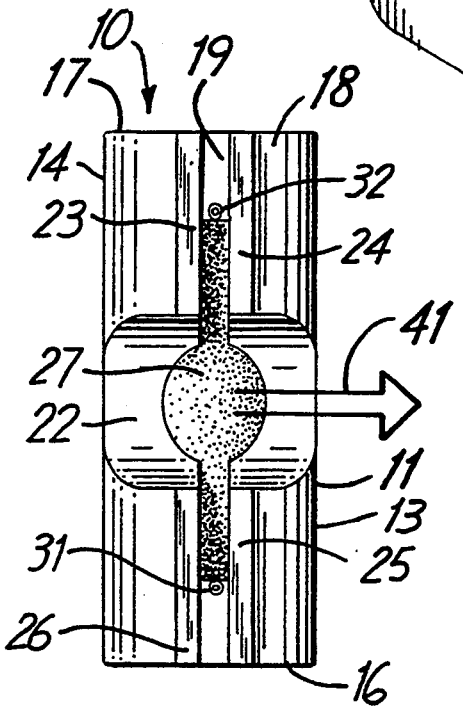
FIG. 2 is a top view of FIG. 1.

Referring to FIGS. 1 and 2, there is shown an ice hockey skate blade sharpener indicated generally at 10. Blade sharpener 10 is used to make a concave groove 34 and define bottom edges 36 and 37 of an ice hockey skate blade 33. Sharpener 10 is a hand held device that can be carried in an equipment bag and used at rink side to sharpen blade 33 to the user's personal preference to match ice conditions and the like.

Sharpener 10 has a generally rectangular body 11 having a flat bottom surface 12 that curves upwardly into a pair of upright side walls 13 and 14. Body 11 has generally flat ends 16 and 17 that extend between side walls 13 and 14. Upper portions of side walls 13 and 14 curve inwardly to define a top wall 18 and body 11.

Figure 8:
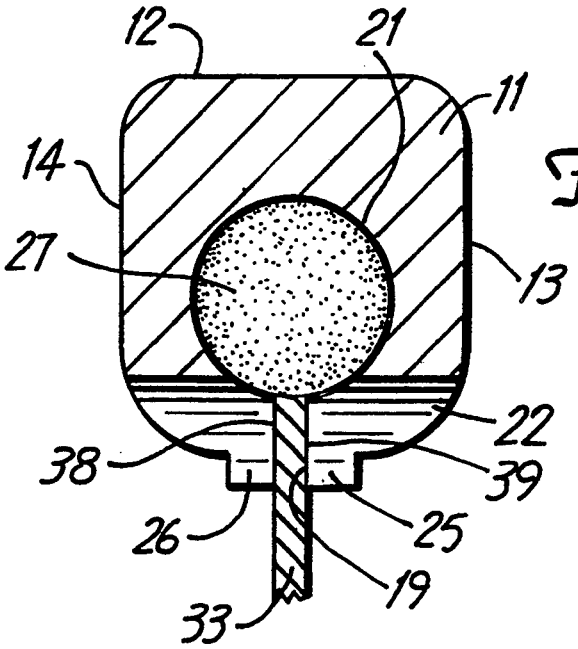
FIG. 8 is a sectional view taken along the line 8—8 of FIG. 7.

A slot 19 extends longitudinally on top wall 18 along the length of body 11. Slot 19 is open to each end 16 and 17 of body 11. As shown in FIG. 8, slot 19 has a width that is substantially the same as the width of blade 33. The body 11 has a centrally located cylindrical bore 21 that extends the length of body 11 and is open to ends 16 and 17. The top of bore 21 is open to slot 19. Slot 19 can have different widths to accommodate blades having different widths.

Figure 5:
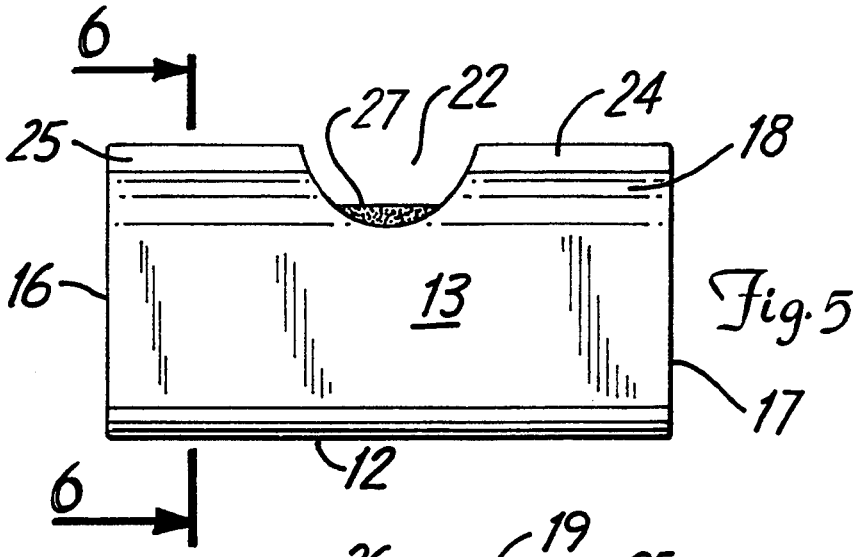
FIG. 5 is a side view of FIG. 1.

Referring to FIGS. 1, 2 and 5, body 11 has a transverse groove or U-shaped recess 22 in top wall 18 that interrupts slot 19. The bottom of groove 22 intersects a top portion of bore 21 adjacent a mid-point of bore 21. Upwardly projecting flanges 23, 24, 25 and 26 are joined to top wall 18 adjacent groove 22. Flanges 23 to 26 have transversely spaced inner surfaces, generally parallel to the inner surfaces of body 11 that form the upper portion of slot 19. Flanges 23 to 26 function to guide skate blade 33 and prevent lateral movement of the blade during the sharpening procedure as hereinafter described.

Figure 6:
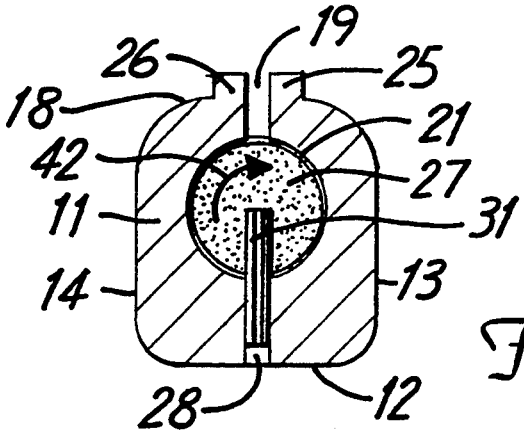
FIG. 6 is a sectional view taken along the line 6—6 of FIG. 5.

Referring to FIGS. 2 and 6, a generally cylindrical skate sharpening material or stone 27 is located in bore 21 of body 11. Stone 27 has a diameter that is slightly less than the diameter of bore 21 whereby stone 27 can be rotated in bore 21, as shown by arrows 41 and 42 of FIGS. 2 and 6, respectively. Stone 27 has a convex curved outer surface that is complementary to concave curve 34 on the bottom of skate blade 33. Stone 27 is rotated to align an unused sharpening surface with the lower end of slot 19. Stone 27 can be removed from bore 21 for replacement or cleaning purposes. The outer surface of stone 27 can have different convex curves to complement different concave curves on the bottom of other skate blades.

Figure 3:
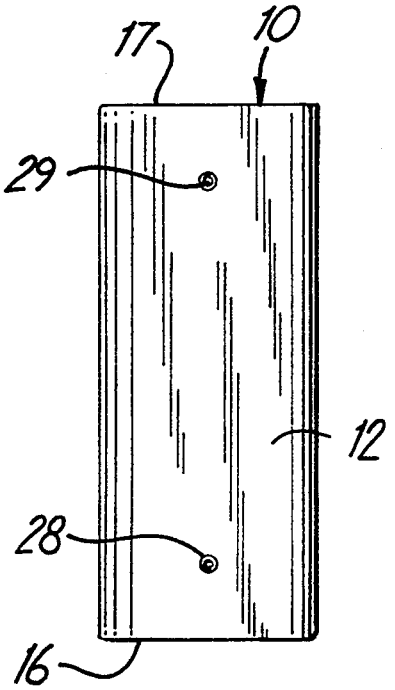
FIG. 3 is a bottom view of FIG. 1.
Figure 4:
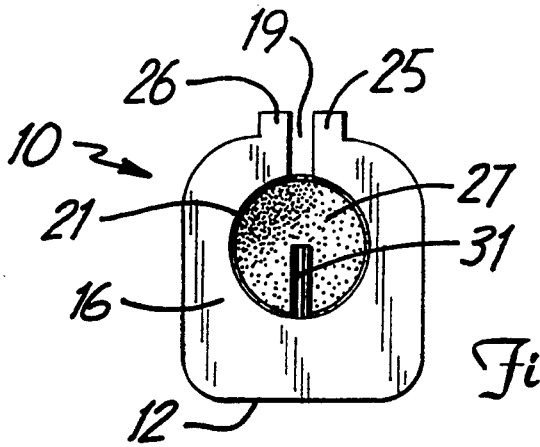
FIG. 4 is an end view of FIG. 1.

Referring to FIG. 3, body 11 has a pair of holes 28 and 29 that extend normal to bottom wall 12 and are open to bore 21 adjacent opposite ends of stone 27. Each hole 28, 29 has a diameter that is less than the width of slot 19. Stops or pins 31 and 32 are inserted into holes 28 and 29, respectively, and project upwardly into bore 21 to limit the longitudinal movement of stone 27 relative to body 11. Holes 28 and 29 are open to bottom wall 12 whereby a punch (not shown) or similar tool can be used to remove pins 31, 32 from holes 28, 29. Pins 31, 32 are generally tubular members having open ends to form a split sleeve. This allows the diameter of pins 31, 32 to be reduced so that pins 31, 32 can be inserted into and removed from holes 28, 29 to facilitate removal of stone 27 from bore 21. When pins 31, 32 are in position adjacent the opposite ends of stone 27, pins 31, 32 expand into tight-fit engagement with body 11 within holes 28 and 29.

Figure 7:
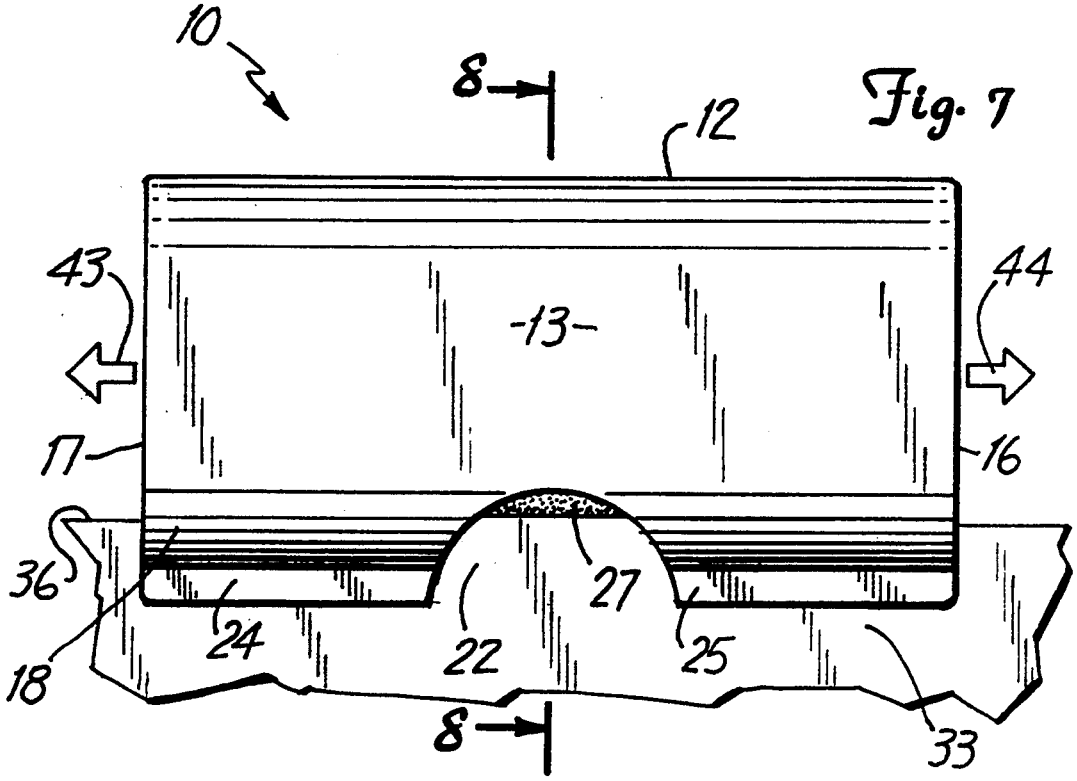
FIG. 7 is an enlarged side view of the skate sharpener of FIG. 1 inserted on a blade of an ice hockey skate.
Figure 9:
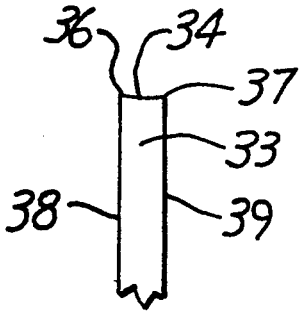
FIG. 9 is a partially sectioned end view of an ice hockey skate blade showing the concave curved bottom surface of the blade.

In use, blade 33 is positioned on a stable surface with groove 34 facing upwardly. Drops of honing oil (not shown) are placed along the length of blade 33 to lubricate the blade. Sharpener 10 is inverted, as shown in FIGS. 8 and 9, and slot 19 is aligned with the longitudinal exterior of blade 33. Side walls 13 and 14 of body 11 are gripped with the thumb and forefingers of one hand of the user. The other hand is placed through the opening in the blade holder of the skate to temporarily fix the position of blade 33. Sharpener 10 is installed on blade 33 by moving blade 33 into slot 19 and into engagement with stone 27. The width of slot 19 is substantially the same as the width of blade 33 whereby sides 38 and 39 of blade 33 are located adjacent the inner surfaces of body 11 that define slot 19. This prevents lateral movement of blade 33 within slot 19 and prevents skewing of blade edges 36 and 37 during the sharpening process. The inner surface of flanges 23 to 26 slidably engage sides 38 and 39. The operator moves sharpener 10 back and forth lengthwise along blade 33, as indicated by arrows 43 and 44 in FIG. 7, several times using minimal downward pressure. Flanges 23 to 26 function to guide blade 33 longitudinally within slot 19 relative to stone 27. The honing oil on blade 33 reduces friction between sides 38 and 39 and the inner surface of flanges 23 to 26 to reduce the force required for the sharpening stroke of the operator.

Sharpener 10 is then lifted off blade 33 to bring stone 27 out of engagement with the blade. The thumb of the operator is placed into groove 22 and used to slightly rotate stone 27, as indicated by arrows 41 and 42 in FIGS. 2 and 6, whereby an unused surface of stone 27 is located directly below the bottom of slot 21. Sharpener 10 is reinstalled on blade 33 by positioning blade 33 in slot 19 into engagement with stone 27. The sides 38 and 39 of blade 33 slidably engage the inner surfaces of flanges 23 to 26 and the inner surfaces of body 11 defining slot 19 preventing lateral movement of blade 33 within slot 19. The operator moves sharpener 10 back and forth lengthwise along blade 33 as shown by arrows 43 and 44 in FIG. 7. Flanges 23 to 26 guide blade 33 within slot 19. The rotating of stone 27 and blade 33 sharpening procedure is repeated until surface 34 has a smooth concave shape.

To finish blade 33, sharpener 10 is removed from blade 33 and a generally flat stone (not shown) is placed on a side 38 of blade 33. The flat stone is moved back and forth along the length of side 38 adjacent edge 36 to remove burrs and other imperfections on blade 33. The flat stone is used to finish opposite side 39 of blade 33 in like manner. When both sides 38 and 39 of blade 33 have been worked with the flat stone, excess oil is removed from blade 33 with a cloth or towel.

Referring to FIGS. 10 to 19, there is shown a modification of the ice hockey skate blade sharpener, indicated generally at 100. Blade sharpener 100 is used to make a concave groove 134 and define bottom edges 136 and 137 of an ice hockey skate blade 133.

Figure 10:
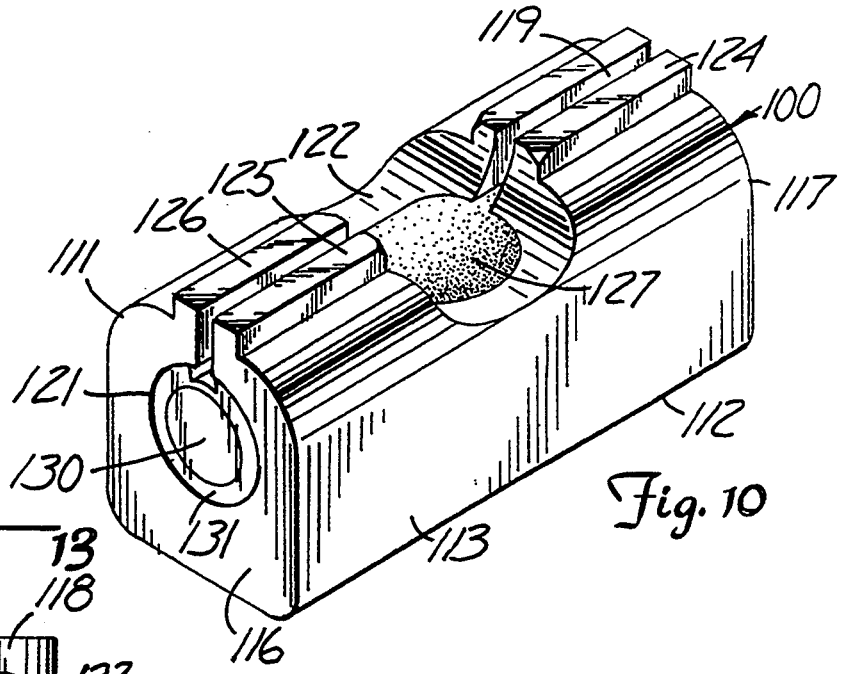
FIG. 10 is a perspective view of a modification of the ice hockey skate sharpener of the invention.
Figure 11:
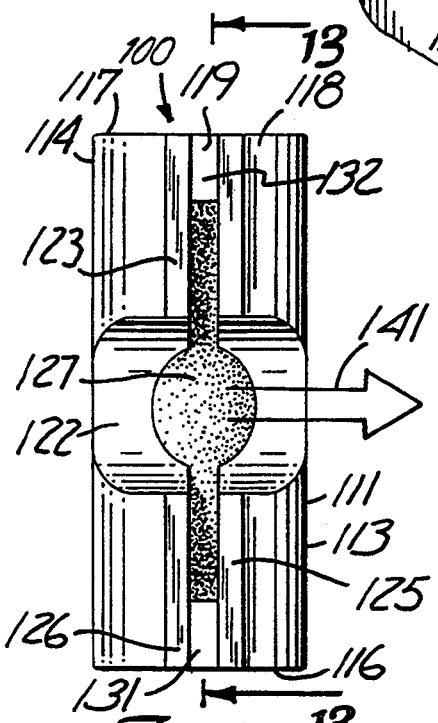
FIG. 11 is a top view of FIG. 10.
Figure 18:
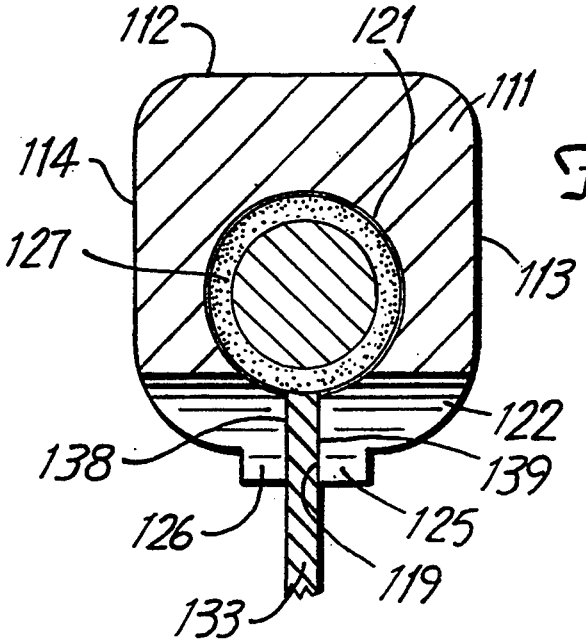
FIG. 18 is a sectional view taken along the line 18—18 of FIG. 17.

Referring to FIGS. 10 and 11, sharpener 100 has a generally rectangular body 111 having a flat bottom 112 curving upwardly into upright side walls 113 and 114. Body 111 has generally flat end surfaces 116 and 117 extending between side walls 113 and 114. The upper portions of side walls 113 and 114 curve inwardly to define a top wall 118 and body 111. A longitudinal slot 119 is located on top wall 118 extending along the length of body 111. Slot 119 is open to ends 116 and 117 of body 111. As shown in FIG. 18, slot 119 has a width substantially the same as the width of ice hockey skate blade 133. Slot 119 can have other widths to accommodate ice hockey skate blades having different widths.

Returning to FIG. 10 and 11, body 111 has a centrally located cylindrical bore 121 that extends the length of body 111 and is open to ends 116 and 117. The top of bore 121 is open to slot 119. Body 111 has a transverse groove or U-shaped recess 122 in top wall 118 interrupting slot 119. The bottom of groove 122 intersects the top portion of bore 121 at a mid-point of bore 121. Upwardly projecting flanges 123, 124, 125 and 126 project from top wall 118 adjacent groove 122. Flange 123 is transversely spaced from flange 124, and flange 125 is transversely spaced from flange 126. The inner surfaces of flanges 123 to 126 extend generally parallel to the inner surfaces of body 111 thereby defining the upper portion of slot 119. Flanges 123 to 126 function to guide skate blade 133 preventing lateral movement of the blade during the sharpening procedure therefor.

Figure 13:
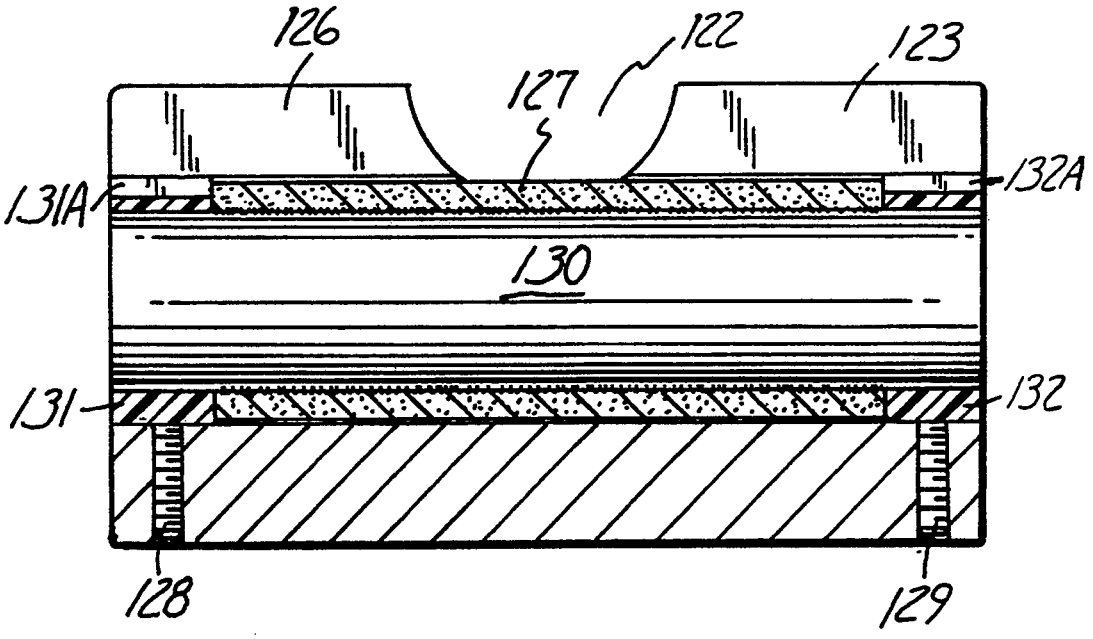
FIG. 13 is an enlarged sectional view taken along the line 13—13 of FIG. 11.
Figure 14:
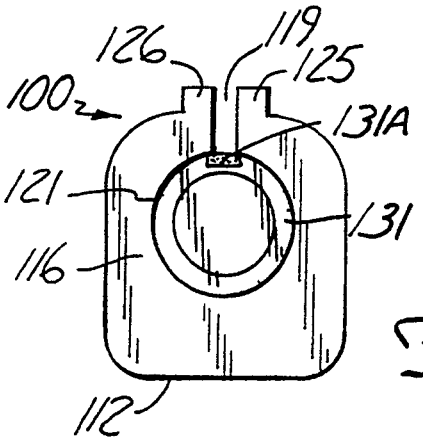
FIG. 14 is an end view of FIG. 10.
Figure 15:
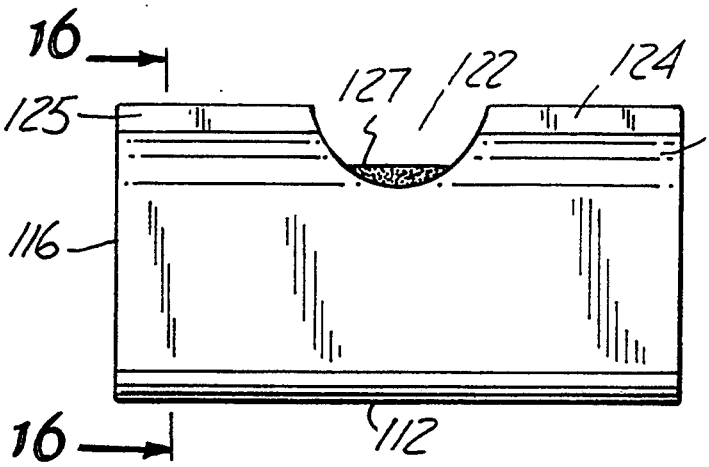
FIG. 15 is a side view of FIG. 10.

Referring to FIG. 13, a generally cylindrical member 130 is rotatably located in bore 121 of body 111. A sleeve 127 surrounds the outer surface of cylindrical member 130 and is attached thereto with an adhesive. Sleeve 127 is made of a skate sharpening material, such as a sharpening stone material. Sleeve 127 has a convex curved outer surface complementary to concave curve 134 on the bottom of skate blade 133. The outer surface of sleeve 127 can have other concave shapes to complement concave curves on the bottom of other skate blades. Sleeve 127 has an outer diameter that is slightly less than the diameter of bore 121 whereby cylindrical member 130 can be rotated within bore 121. The outer ends of sleeve 127 are spaced inwardly from the ends of cylindrical member 130.

A pair of annular bearings 131 and 132 are telescopically located on opposite ends of cylindrical member 130 adjacent sleeve 127. Bearings 131 and 132 have an outer diameter substantially the same as the diameter of bore 121 and an inner diameter which is slightly more than the diameter of the ends of cylindrical member 130 whereby member 130 can be rotated relative to the bearings within bore 121. Bearings 131 and 132 engage the outer ends of sleeve 127 to prevent longitudinal movement of member 130 relative to body 111. Cylindrical member 130 is rotated to move an unused sharpening surface of sleeve 127 into alignment with the lower end of slot 119. Each bearing 131, 132 has a longitudinal groove 131A, 132A in a top portion thereof in alignment with slot 119. Grooves 131A and 132A allow sharpener 100 to be moved back and forth along skate blade 133 without interference from bearings 131 and 132.

Figure 12:
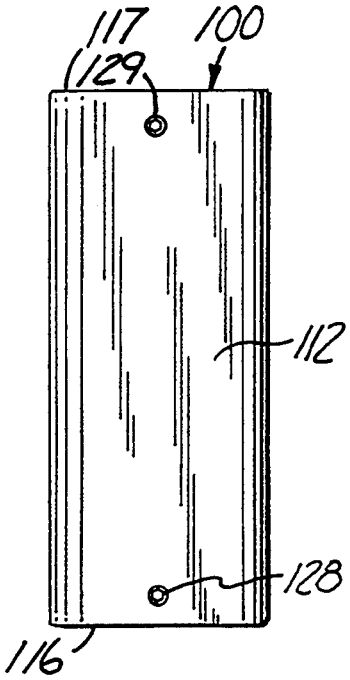
FIG. 12 is a bottom view of FIG. 10.
Figure 16:
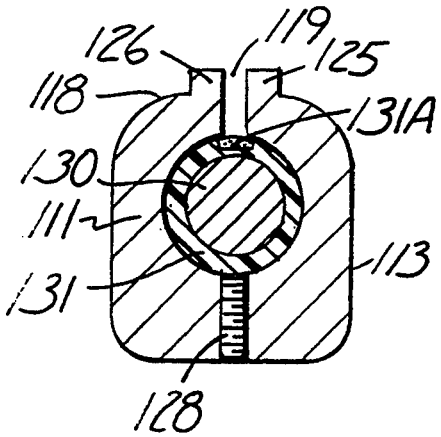
FIG. 16 is a sectional view taken along the line 16—16 of FIG. 15.

Referring to FIG. 12, body 111 has vertically threaded holes open to bottom wall 112 and bore 121 accommodating threaded screws 128 and 129 for holding bearings 131 and 132 in the outer ends of bore 121. A hand tool (not shown) is used to tighten screws 128 and 129 into engagement with bearings 131 and 132, as shown in FIGS. 13 and 16, to fix the position of the bearings relative to body 111 and prevent longitudinal movement of cylindrical member 130. Screws 128 and 129 are moved out of engagement with bearings 131 and 132 whereby cylindrical member 130 can be removed from bore 121 for replacement or cleaning purposes.

Figure 17:
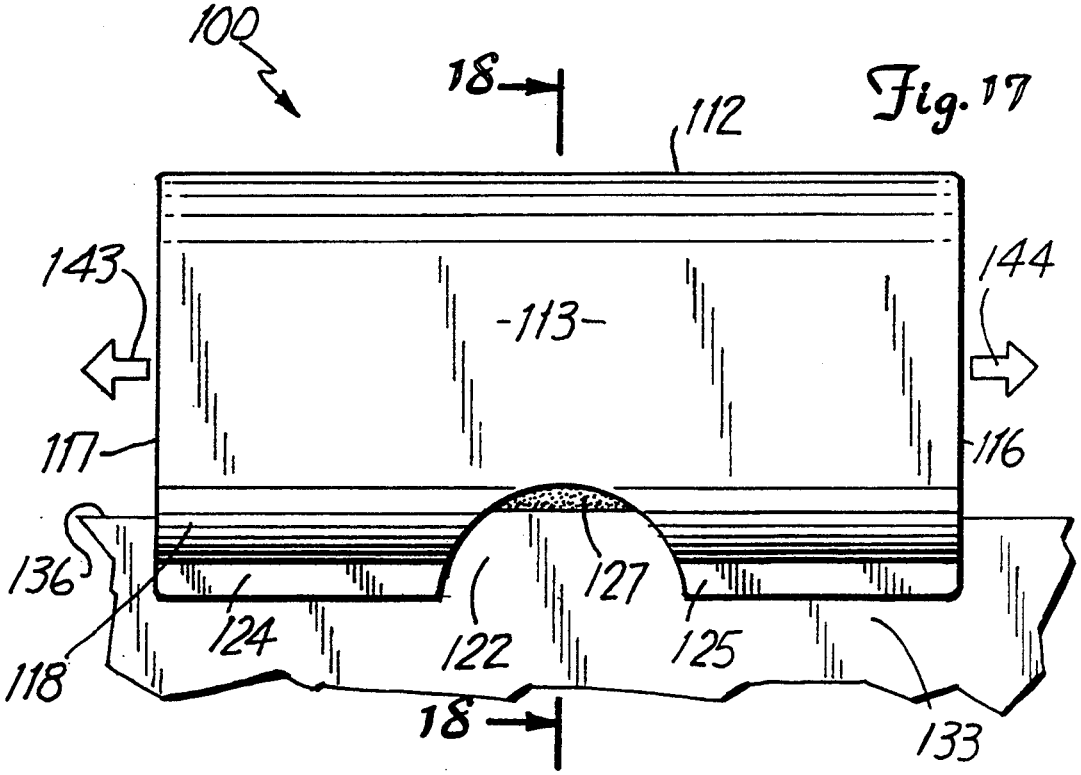
FIG. 17 is an enlarged side view of the skate sharpener of FIG. 10 inserted on a blade of an ice hockey skate.
Figure 19:
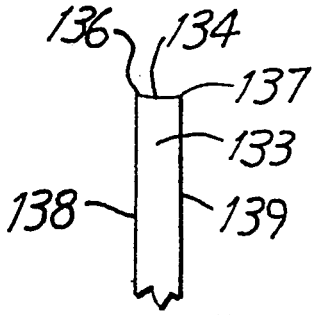
FIG. 19 is a partially sectioned end view of an ice hockey skate blade showing the concave curved bottom surface of the blade.

In use, as shown in FIGS. 17 to 19, blade 133 is positioned so that concave groove 134 faces upwardly. Drops of honing oil (not shown) are placed along the length of blade 133 for lubrication. The honing oil reduces friction between sides 138 and 139 of blade 133 and the inner surfaces of body 111 and flanges 123 to 126. With sharpener 100 in an inverted position, the sharpener is placed over blade 133 with slot 119 aligned with the longitudinal exterior of blade 133. Side walls 113 and 114 of sharpener body 111 are gripped with the thumb and forefingers of one hand of the operator. The other hand is positioned through the opening in the blade holder of the skate to fix the position of blade 133. Moving blade 133 into slot 119 moves the bottom surface of the blade into engagement with sleeve 127. The width of slot 119 is substantially the same as that of blade 133 whereby sides 138 and 139 of blade 133 are located adjacent the inner surfaces of body 111 and flanges 123–126. Flanges 123–126 function to guide blade 133 longitudinally within slot 119 relative to sleeve 127. This prevents lateral movement of blade 133 within slot 119 and skewing of blade edges 136 and 137 during the sharpening process. The user person moves sharpener 100 back and forth lengthwise along blade 133, as indicated by arrows 143 and 144 in FIG. 17, several times using minimal downward pressure until surface 134 has a smooth concave shape.

To finish blade 133, sharpener 100 is removed from blade 133 and a generally flat stone (not shown) is placed on side 138 of the blade. The flat stone is rubbed back and forth along the length of side 138 to remove burrs and other imperfections on blade 133. Side 139 of blade 133 is finished with the flat stone in like manner. When sides 138 and 139 have been finished, excess oil is wiped from blade 133 with a cloth or towel.

To rotate cylindrical member 130, the thumb of the user person is placed into groove 122 and used to slightly turn member 130, as indicated by arrow 141 in FIG. 11, whereby an unused surface of sleeve 127 is located below the bottom of slot 121. The ends of cylindrical member 130 rotate on bearings 131 and 132 as the unused surface of sleeve 127 is position adjacent the slot 121.

While there has been shown and described preferred embodiments of the ice skate blade sharpener according to the present invention, it is understood that changes in structure, materials and design can be made by persons skilled in the art without departing from the substance of the invention. The invention is defined in the following claims.

I claim:

1. A device for sharpening the blade of an ice skate comprising: a body having end walls and a top wall joined to the opposite end walls, a longitudinal bore open to each end wall, and a longitudinal slot extended normal to the top wall and open to the bore and each end wall for accommodating the blade, lip means projecting upwardly normal to the top wall and adjacent opposite sides of the slot, cylindrical means located in the bore, the cylindrical means having a member and sleeve means attached to the member engageable with a blade of a skate located in the slot to sharpen the blade, bearing means located in the bore in each end wall, said member having ends rotatably mounted on the bearing means thereby rotatably supporting the cylindrical means on the bearing means, means removably mounted on the body for holding the bearing means in a fixed position within said bore to prevent rotational and longitudinal movement of the bearing means relative to the body, and a transverse groove extended into the top wall whereby the cylindrical means can be manually rotated within said bore to position a selected portion of the sleeve means adjacent the slot.

2. The device of claim 1 wherein: the bearing means include groove means located in longitudinal alignment with the longitudinal slot in the body to space the blade in the slot from the bearing means.

3. The device of claim 1 wherein: the means removably mounted on the body comprise a pair of fasteners threaded through vertical holes in the body into engagement with the bearing means to prevent rotational and longitudinal movements of the bearing means relative to the body.

4. The device of claim 1 wherein: the transverse groove has a bottom portion that intersects a top portion of the bore whereby the cylindrical means can be manually rotated within said bore.

5. The device of claim 1 wherein: the sleeve means is a generally tubular stone material secured to the member, the tubular stone material having a diameter that is slightly less than a diameter of the bore.

6. The device of claim 1 wherein: the sleeve means has a convex curved outer surface complementary to a concave curved bottom surface of the blade.

7. The device of claim 1 wherein: the longitudinal slot has a width substantially the same as a width of the blade of an ice skate.

8. The device of claim 1 wherein: the lip means comprise transversely spaced flanges, each flange having a inner surface vertically aligned with an outer side of the slot.

9. The device of claim 8 wherein: the transverse distance between the inner surfaces of the flanges is substantially the same as a width of the slot.

10. A device for sharpening the blade edges of an ice skate comprising: a body having a top wall joined to opposite end walls, a bore extended longitudinally through the body and open to the end walls, a longitudinal slot extended normal to the top wall and open to the bore and end walls of the body, lip means projecting upwardly normal to the top wall, the lip means having transversely spaced surfaces located in general vertical alignment with outer sides of the slot; cylindrical means located in the bore, the cylindrical means having opposite ends and sleeve means engageable with a skate blade for sharpening edges of the skate blade, bearing means located in the bore in each end wall engageable with the opposite ends of the cylindrical means thereby rotatably mounting the cylindrical means on the bearing means, means removably mounted on the body and engageable with the bearing means to fix the position of the bearing means on the body and prevent longitudinal movement of the cylindrical means relative to the body whereby when the blade is inserted into the slot positioning a bottom surface of the blade into engagement with the sleeve means, the body can be moved longitudinally relative to the blade to sharpen the edges of the blade, and transverse groove means extended into the top wall through middle portions of the slot and lip means whereby the cylindrical means can be manually rotated within the bore to position a selected portion of the sleeve means adjacent the slot.

11. The device of claim 10 wherein: the means removably mounted on the body comprise a pair of fasteners threaded through vertical holes in the body into engagement with the bearing means to prevent rotational and longitudinal movements of the bearing means relative to the body.

12. The device of claim 10 wherein: the transverse groove has a bottom portion that intersects a top portion of the bore.

13. The device of claim 10 wherein: the cylindrical means includes a cylindrical member and the sleeve means is a generally tubular stone material secured to the cylindrical member, the tubular stone material having a diameter that is slightly less than a diameter of the bore.

14. The device of claim 10 wherein: the sleeve means has a convex curved outer surface complementary to a concave curve of the bottom surface of the blade.

15. The device of claim 10 wherein: the slot has a width substantially the same as a width of the blade.

16. The device of claim 10 wherein: the transverse distance between the transversely spaced surfaces of the lip means is substantially the same as a width of the slot.

17. A skate blade edge sharpener comprising: body means having a cylindrical bore open to opposite ends of the body means, a generally cylindrical member located in the bore, a sleeve of stone material secured to the cylindrical member engageable with a skate blade for sharpening edges of the skate blade, sleeve bearing means located in the bore in each end of the body, the cylindrical member having opposite ends mounted on the bearing means whereby the cylindrical member and sleeve are rotatable relative to the bearing means and the bore to move the sleeve to a selected position, means removably mounted on the body means projecting into the bore and engageable with the bearing means to fix the position of the bearing means on the body and prevent longitudinal movement of the cylindrical member and sleeve relative to the body means, the body means having an elongated slot extended generally parallel to the bore, the slot having a fixed width and being open to the bore and to the opposite ends of the body providing access to an outer surface of the sleeve whereby when the blade is inserted into the slot positioning a bottom surface of the blade into engagement with the outer surface of the sleeve, the body means can be moved longitudinally relative to the blade to sharpen the edges of the blade, and recess means in said body means bisecting said slot and open to the bore whereby the cylindrical member can be manually rotated within said bore.

18. The sharpener of claim 17 wherein: the recess means is a, transverse groove having a bottom portion, the bottom portion of the groove intersecting a top portion of the bore.

19. The sharpener of claim 17 wherein: the body means includes upwardly projecting transversely spaced flanges, each flange having an inner surface vertically aligned with an outer side of the slot.

20. The sharpener of claim 19 wherein: the transverse distance between the inner surfaces of the flanges is substantially the same as a width of the slot.

21. The sharpener of claim 17 wherein: the slot has a width substantially the same as a width of the blade.

22. The sharpener of claim 17 wherein: the outer surface of the sleeve has a convex curve that is complementary to a concave curve of the bottom surface of the blade.

23. The sharpener of claim 17 wherein: the bearing means include groove means located in longitudinal alignment with the elongated slot in the body means.

24. The sharpener of claim 17 wherein: the sleeve is a tubular stone material secured to the cylindrical member, said tubular stone material having a diameter that is slightly less than the diameter of the bore.

25. A device for sharpening a longitudinal blade comprising: a body having opposite end walls and a top wall joined to the opposite end walls, said body having a longitudinal bore open to each end wail and a longitudinal slot extended normal to the top wall and open to the bore and each end wall for accommodating the blade, cylindrical means located in the bore engageable with the blade for sharpening the blade, said cylindrical means having a member and sleeve means attached to the member engageable with the blade located in the slot to sharpen the blade, bearing means located in the bore in each end wall, said member having ends mounted on the bearing means thereby rotatably supporting the cylindrical means on the bearing means, means mounted on the body to fix the longitudinal and circumferential position of the bearing means on the body and prevent longitudinal movement of the cylindrical means relative to the body, and a groove extended into the top wall whereby the cylindrical means can be manually rotated within said bore to position a selected portion of the sleeve means adjacent the slot.

26. The device of claim 25 wherein: the means mounted on the body to fix the position of the bearings means on the body comprise a pair of fasteners threaded through vertical holes in the body into engagement with the bearing means thereby preventing longitudinal and rotational movement of the beating means relative to the body.

27. The device of claim 25 wherein: the bearing means include groove means located in longitudinal alignment with the elongated slot in the body means to space the blade located in the slot from the bearing means.

28. The device of claim 25 wherein: the sleeve means is a generally tubular stone material secured to the member, the tubular stone material having a diameter that is slightly less than a diameter of the bore.

* * * * *